US012618167B2

(12) United States Patent
Wall et al.

(10) Patent No.: US 12,618,167 B2
(45) Date of Patent: May 5, 2026

(54) METHOD FOR OPERATING AN ELECTROLYSIS SYSTEM, AND ELECTROLYSIS SYSTEM

(71) Applicant: Siemens Energy Global GmbH & Co. KG, Munich (DE)

(72) Inventors: Dirk Wall, Mülheim (DE); Sven Schumann, Wilhermsdorf (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 0 days.

(21) Appl. No.: 19/099,138

(22) PCT Filed: Jul. 7, 2023

(86) PCT No.: PCT/EP2023/068866
§ 371 (c)(1),
(2) Date: Jan. 28, 2025

(87) PCT Pub. No.: WO2024/022789
PCT Pub. Date: Feb. 1, 2024

(65) Prior Publication Data

US 2025/0257488 A1 Aug. 14, 2025

(30) Foreign Application Priority Data

Jul. 28, 2022 (DE) ..... 10 2022 207 777.6

(51) Int. Cl.
*C25B 15/02* (2021.01)
*C25B 1/04* (2021.01)

(52) U.S. Cl.
CPC ..... *C25B 15/02* (2013.01); *C25B 1/04* (2013.01)

(58) Field of Classification Search
CPC ..... C25B 15/02; C25B 1/04
See application file for complete search history.

(56) References Cited

U.S. PATENT DOCUMENTS

| | | | | |
|---|---|---|---|---|
| 11,060,196 | B2 | 7/2021 | Colomar | |
| 2006/0260933 | A1 | 11/2006 | Mitlitsky et al. | |
| 2007/0227167 | A1* | 10/2007 | Shapiro | F25B 49/022 62/175 |
| 2008/0005964 | A1* | 1/2008 | Hajiaghajani | C01B 3/501 48/61 |

(Continued)

FOREIGN PATENT DOCUMENTS

| | | | |
|---|---|---|---|
| CN | 100534840 | C | 9/2009 |
| EP | 0085285 | A1 | 8/1983 |

(Continued)

*Primary Examiner* — Bryan D. Ripa
(74) *Attorney, Agent, or Firm* — Laurence A. Greenberg; Werner H. Stemer; Ralph E. Locher

(57) ABSTRACT

An electrolysis system includes at least one electrolyzer for generating hydrogen and oxygen as products, and at least two downstream compressors for compressing at least one of the products produced in the electrolyzer. A method of operating the electrolysis system in a part-load operation of the electrolyzer that is optimized in terms of efficiency and is also cost-effective. During the part load operation of the electrolyzer, a first group of compressors is operated in part-load operation, while the compressor(s) of a second group can be switched on or off individually for full-load operation.

7 Claims, 1 Drawing Sheet

(56) References Cited

U.S. PATENT DOCUMENTS

| | | | | |
|---|---|---|---|---|
| 2008/0131258 | A1* | 6/2008 | Liepold | F04D 27/0269 700/282 |
| 2008/0260541 | A1* | 10/2008 | Lifson | H02P 23/08 417/44.11 |
| 2011/0042228 | A1 | 2/2011 | Hinatsu et al. | |
| 2013/0126360 | A1* | 5/2013 | Ise | C25B 1/04 205/412 |
| 2013/0287592 | A1* | 10/2013 | Kobayashi | F04C 18/0207 417/2 |
| 2019/0185396 | A1 | 6/2019 | Schulz et al. | |
| 2020/0056290 | A1 | 2/2020 | Yang et al. | |
| 2020/0283362 | A1* | 9/2020 | MacGregor | C12M 21/04 |
| 2022/0033983 | A1* | 2/2022 | Higginbotham | C25B 15/02 |
| 2022/0290309 | A1 | 9/2022 | Wehrman et al. | |
| 2022/0316076 | A1 | 10/2022 | Peschel et al. | |
| 2022/0397117 | A1* | 12/2022 | Henzler | F04B 41/06 |
| 2023/0313397 | A1* | 10/2023 | Seike | H01M 8/04388 205/337 |
| 2023/0375241 | A1* | 11/2023 | Liu | F25B 1/10 |

FOREIGN PATENT DOCUMENTS

| | | | |
|---|---|---|---|
| EP | 3957772 | A1 | 2/2022 |
| EP | 4067533 | A1 | 10/2022 |
| EP | 4105490 | A1 | 12/2022 |
| EP | 4105491 | A1 | 12/2022 |
| JP | 2003342768 | A | 12/2003 |
| JP | 2018135551 | A | 8/2018 |

* cited by examiner

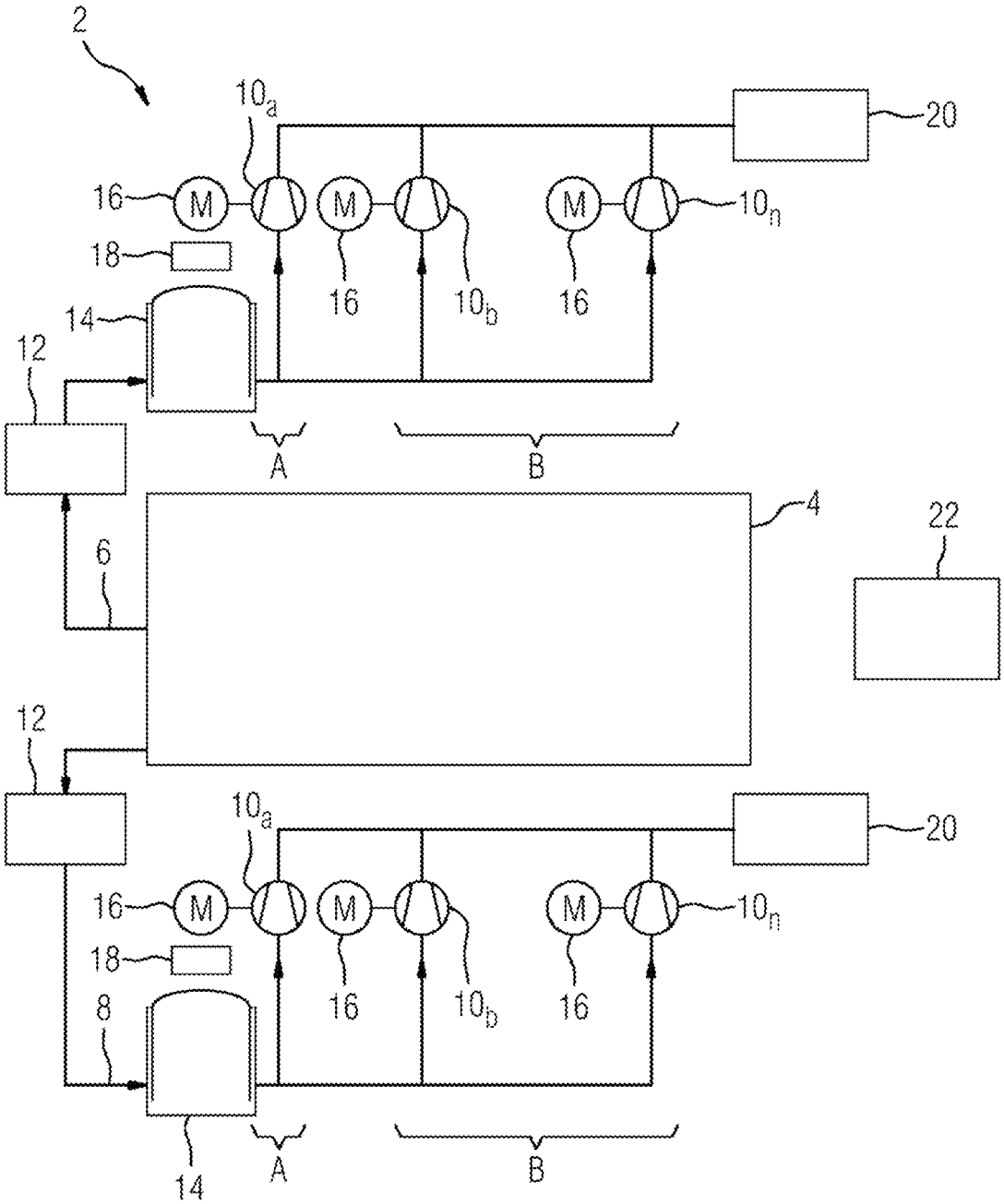
2
10a
20
16
M
M
M
10n
18
16
10b
16
14
12
A
B
4
22
6
12
10a
20
16
M
M
M
10n
18
16
10b
16
8
14
A
B

METHOD FOR OPERATING AN ELECTROLYSIS SYSTEM, AND ELECTROLYSIS SYSTEM

FIELD AND BACKGROUND OF THE INVENTION

The invention relates to a method for operating an electrolysis system comprising at least one electrolyzer for generating hydrogen and oxygen as products, and at least two downstream compressors for compressing at least one of the products which is generated in the electrolyzer. The invention further relates to an electrolysis system which is appropriate for executing the method.

An electrolysis system is a device which initiates a substance conversion by means of electric current (electrolysis). In line with the wide range of different electrochemical electrolysis processes, there is also a multiplicity of electrolysis systems, including, for example, an electrolysis system for water electrolysis.

Nowadays, hydrogen is produced from water, for example by means of proton exchange membrane (PEM) electrolysis, or alkaline electrolysis. By means of electrical energy, electrolysis systems produce hydrogen and oxygen from an infeed of water. This process is executed in an electrolysis stack, which is comprised of multiple electrolysis cells. Water is introduced as an educt into the electrolysis stack, to which a DC voltage is applied, and, further to the throughflow thereof in the electrolysis cells, two fluid streams are discharged, comprised of water and gas bubbles ($O_2$ or $H_2$). Further to liquid-gas separation, hydrogen and oxygen are retrieved as products, which can then be compressed in a subsequent step.

In alkaline electrolysis, in general, a small number of stacks (1 or 2) are connected in series, and form an electrolysis unit. In a PEM electrolyzer, multiple stacks or modules are connected in series, and form a module series. An electrolysis unit is formed of a number of module series.

In the event of a part-load operation of the electrolysis system, there is a distinction between the part-load behavior of the electrolyzers and of the downstream compressors. The part-load efficiency, mass flow and operating behavior of electrolyzers assume a substantially continuous characteristic. On the compression side, for part-load mass flows, it is customary for individual compressors to be switched on and off, potentially resulting in stages or step changes in efficiency. This issue occurs, in particular, as the size of systems increases.

For the resolution of this issue, costly options are available, including variable frequency drives for compressors, which enable a continuous adjustment of compressor capacity.

A compressor drive system for controlling gas pressure in a pressurized volume of gas connected to the compressor is described e.g. in EP 0 085 285 A1. An AC power drive is directly coupled to the compressor, which is driven at the same speed as the drive. The pressure in the volume of gas is detected by pressure capture means, which are connected to a frequency converter. The converter simultaneously varies the amplitude and frequency of the drive voltage which is supplied to the drive. This variation is executed in response to volumetric pressure changes, thus forming a control loop.

Although, by means of a frequency converter, the part-load behavior of compressors can be improved and adapted to the part-load behavior of electrolysis, this solution is associated with very high costs.

SUMMARY OF THE INVENTION

The fundamental object of the invention is therefore the provision of a part-load operation of the electrolysis system which is optimized with respect to efficiency and is also cost-effective.

According to the invention, this object is fulfilled by a method for operating an electrolysis system comprising at least one electrolyzer for generating hydrogen and oxygen as products, and at least two downstream compressors for compressing at least one of the products which is generated in the electrolyzer, wherein, in a part-load operation of the electrolyzer, a first group of compressors is operated in part-load operation, whereas one or more compressors in a second group can be switched on or off individually for full-load operation.

According to the invention, this object is moreover fulfilled by an electrolysis system which is appropriate for executing the method, comprising at least one electrolyzer for generating hydrogen and oxygen as products, at least two downstream compressors for compressing at least one of the products which is generated in the electrolyzer, and a control unit which is configured, in a part-load operation of the electrolyzer, to operate a first group of compressors in part-load operation, whereas one or more compressors of a second group are switched on or off individually for full-load operation.

Advantages and preferred configurations described hereinafter with respect to the method can be appropriately applied to the electrolysis system.

The invention proceeds from the consideration whereby the design rating and control of compressors is attuned, in a cost-effective manner, to load variations in the electrolysis process, wherein not all compressors are rated for full-load operation, but only a number of compressors, which form the first group. In the event of a part-load operation of the electrolysis system, the remaining compressors are either operated at full-load, or are switched off: these form the second group. Each group can comprise one or more compressors. If the system incorporates only two compressors, one compressor is assigned to the first group, and the other to the second group.

The above-described method has the advantage that the switched-on compressors in the second group can operate in an optimum manner. Each of the compressors in the second group is actuated individually, i.e., independently of the other compressors in the second group. A high degree of flexibility for the adjustment of compression capacity to the part-load operation of the electrolysis system is thus ensured at all times. In the event of a multiplicity of compressors, in particular, these are arranged in parallel-operated compressor trains. Individual compressor trains are switched on and off in an efficiency-optimized manner. Although this applies to all compressors, it is particularly relevant for the compressors in the second group. A load change is thus executed by a sub-quantity of compressor trains only.

In a parallel manner hereto, the electrolyzer is operated in an efficiency-optimized manner, in order to enable a maximum overall system efficiency. The operator or the control unit is provided with an option for the preselection of a part-load of the electrolysis system, in accordance with efficiency-optimized compressor working points. A relatively accurate exclusion of efficiency-optimized system working points is enabled accordingly. Load changes, as described above, are executed using compressors in the first group which are equipped for part-load operation, and using the switch-on or switch-off of compressors in the second group. The changeover between different load points can be implemented in an abrupt or stepless manner, wherein a stepless changeover is the preferred variant.

It is moreover appropriate that electrolyzers and their associated process units, according to the dimensioning and grouping thereof, are adapted to the compression, in particular such that they achieve optimum efficiency at the efficiency-optimized compressor working points. As a result, the overall efficiency of the electrolysis system can be improved, as the compressors can also operate closer to, or at, their efficiency-optimized working points.

According to a preferred embodiment, the first group of compressors is set to part-load operation, by means of a variable frequency drive. These compressors can enable a smoothing of potential compressor working points, or an alignment with electrolysis behavior in part-load operation. In comparison with alternative embodiments for the introduction of part-load operation, e.g. by means of valve switching (a reduction of mass flow by the switch-off/switch-on of valves), or a variation of the compressor volume, the employment of a variable frequency drive is characterized by superior efficiency, i.e., by the lowest energy consumption.

According to a further preferred embodiment, the compressors are operated in a parallel-connected arrangement. In this manner, particularly high mass flows of product can be compressed. By means of parallel connection, compressor trains are formed, wherein each train can comprise one or more compressors.

With respect to a particularly cost-effective embodiment, the number of compressors in the first group is preferably smaller than the number of compressors in the second group. Only a minimum sub-quantity of compressors or compressor trains employed are equipped for part-load compressor operation, e.g. using variable frequency drives. At the same time, as many of the active compressors as possible are operated at maximum efficiency (in full-load operation), in order to reduce part-load losses.

Preferably, the first and second group of compressors are employed for the exclusive compression of hydrogen produced, as hydrogen is the main product of the electrolysis process, and the compression thereof is thus consistently advantageous.

Advantageously, the compressors are configured as piston compressors and/or as screw compressors, as this type of compressor is best suited to the load range of the mass flow which is generated in the electrolysis process.

BRIEF DESCRIPTION OF THE DRAWING

The single FIGURE of the drawing is a schematic illustration of an electrolysis system.

DETAILED DESCRIPTION OF THE INVENTION

One exemplary embodiment of the invention is described in greater detail with reference to a drawing. The single FIGURE represents an electrolysis system 2, comprising an electrolyzer 4 for generating hydrogen 6 and oxygen 8 as products. Each of the product streams 6, 8 undergoes gas conditioning, which is represented by the block 12. Gas conditioning describes the catalysis of carrier gases wherein a thermal reaction between residual oxygen and oxygen is initiated in the hydrogen stream, and the converse operation is also executed on the oxygen side. Thereafter, the respective product gas is generally dried and optionally cooled. The products can then be initially stored in a gas container 14, or can be compressed directly by means of multiple downstream compressors 10.

The electrolyzer 4, for example, is a proton exchange membrane (PEM) electrolyzer, or an alkaline electrolyzer. Alternatively, it can also be e.g. an anion exchange membrane (AEM) electrolyzer. In the FIGURE, the electrolyzer 4 is particularly representative of multiple electrolysis units, which are arranged in series or in parallel.

On each product side, two or more compressors 10 are provided ($\mathbf{10}_a$, $\mathbf{10}_b$, . . . $\mathbf{10}_n$, wherein n>=2). These are configured in a parallel-connected arrangement, in "trains". In the FIGURE, only one compressor $\mathbf{10}_a$, $\mathbf{10}_b$, . . . $\mathbf{10}_n$ is provided per compressor train, wherein, alternatively, the trains can also comprise two or more compressors. A series-connected arrangement of the compressors $\mathbf{10}_a$, $\mathbf{10}_b$, . . . $\mathbf{10}_n$ or any combination of parallel- and series-connected arrangements are also conceivable, depending upon the requirements of the electrolysis system 2.

Each of the compressors 10 is equipped with a drive 16. At least one compressor $\mathbf{10}_a$ further incorporates a variable frequency drive 18, which comprises a frequency converter. The variable frequency drive 18 enables, by means of a three-phase AC-powered induction drive, an infinitely variable speed control. On the respective product side, the one or more compressors $\mathbf{10}_a$ having the variable frequency drive 18 form(s) a first group A. In the exemplary embodiment represented, the remaining compressors $\mathbf{10}_b$ . . . $\mathbf{10}_n$ form a second group B.

Finally, the compressed products, hydrogen 6 or oxygen 8, are conditioned in step 20, and are discharged from the electrolysis system 2.

The electrolysis system 2 further comprises a control unit, which is symbolically illustrated by the block 22. In particular, the control unit 22 controls the drives 16 of the compressors $\mathbf{10}_a$, $\mathbf{10}_b$, . . . $\mathbf{10}_n$ on the basis of data from the electrolyzer 4.

Under certain circumstances, the load of the electrolyzer 4 can undershoot the full load thereof, i.e., the electrolyzer 4 is operated in part-load operation. The control unit 22 controls the first group A of compressors 10 such that the latter are also operated in part-load operation, whereas the compressors 10 in the second group B are switched on or off individually, i.e., in a mutually independent manner. If the compressors 10 in the second group B are switched on, the latter are operated at full load. In the design layout of the electrolysis system 2, optimum efficiencies of the system components are mutually attuned, i.e., in particular, the number of compressors 10 is adapted to the number of electrolysis units, such that an operating mode of the overall system at an optimum efficiency is enabled.

In the FIGURE, on each of the two product sides, a division of the compressors $\mathbf{10}_a$, $\mathbf{10}_b$, . . . $\mathbf{10}_n$ into two groups A, B is represented. However, it is also conceivable that one or more compressors $\mathbf{10}_a$ are equipped with a variable frequency drive 18 for one product only, in particular on the hydrogen product side.

The invention claimed is:

1. A method for operating an electrolysis system with at least one electrolyzer for generating hydrogen and oxygen as products, and a plurality of downstream compressors for compressing at least one of the products generated in the electrolyzer, the method comprising:

operating the electrolyzer in a part-load operation; and while operating the electrolyzer in the part-load operation, operating a first group of the downstream compressors in part-load operation, and individually switching on and off one or more compressors in a second group of the downstream compressors;

wherein each of the one or more compressors in the second group of the downstream compressors is independently operated in a manner exclusively selected from a group consisting of being switched off and being turned on to operate at full load; and wherein the first group of the downstream compressors includes a plurality of compressors and a number of compressors in the first group is smaller than a number of compressors in the second group.

2. The method according to claim 1, which comprises setting the first group of compressors to the part-load operation by way of a variable frequency drive.

3. The method according to claim 1, which comprises operating the at least two downstream compressors in a parallel-connected arrangement.

4. The method according to claim 1, which comprises exclusively employing the first group and the second group of compressors for compressing the hydrogen produced in the electrolyzer.

5. An electrolysis system, comprising:

at least one electrolyzer for generating hydrogen and oxygen as products;

a plurality of compressors connected downstream of said at least one electrolyzer and configured for compressing at least one of the products generated in said at least one electrolyzer;

a controller configured, in a part-load operation of said at least one electrolyzer, to operate a first group of the downstream compressors in part-load operation, and to individually switch on and off one or more compressors in a second group of the downstream compressors;

wherein each of the one or more compressors in the second group of the downstream compressors is independently operated in a manner exclusively selected from a group consisting of being switched off and being turned on to operate at full load; and wherein the first group of the downstream compressors includes a plurality of compressors and a number of compressors in the first group is smaller than a number of compressors in the second group.

6. The electrolysis system according to claim 5, configured for executing the method according to claim 1.

7. The electrolysis system according to claim 5, wherein said compressors are at least one of piston compressors or screw compressors.

* * * * *